US007069669B2

(12) United States Patent
Park et al.

(10) Patent No.: US 7,069,669 B2
(45) **Date of Patent: *Jul. 4, 2006**

(54) CLOTHES DRYER

(75) Inventors: Young-Hwan Park, Seoul (KR); Si-Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/958,330

(22) Filed: Oct. 6, 2004

(65) Prior Publication Data

US 2005/0252030 A1 Nov. 17, 2005

(30) Foreign Application Priority Data

May 11, 2004 (KR) ..... 10-2004-0033176

(51) Int. Cl.
*F26B 11/02* (2006.01)

(52) U.S. Cl. ..... 34/603; 34/606

(58) Field of Classification Search ..... 34/61, 34/82, 601, 602, 603, 606
See application file for complete search history.

(56) References Cited

U.S. PATENT DOCUMENTS

| | | | | |
|---|---|---|---|---|
| 2,617,203 | A * | 11/1952 | Murray | 34/601 |
| 3,364,585 | A * | 1/1968 | Fish et al. | 34/527 |
| 4,753,018 | A | 6/1988 | Golichowski | |
| 4,875,298 | A | 10/1989 | Wright | |
| 5,042,172 | A * | 8/1991 | Foco et al. | 34/235 |
| 6,678,969 | B1 * | 1/2004 | Hong | 34/595 |

* cited by examiner

*Primary Examiner*—S. Gravini
(74) *Attorney, Agent, or Firm*—Greenblum & Bernstein, P.L.C.

(57) ABSTRACT

A clothes dryer comprises: a cabinet; a drum rotatably installed within the cabinet; and an exhaust port for discharging air having passed through the drum, wherein the exhaust port includes first and second exhaust pipes respectively diverged to both sides of the cabinet, and exits of the first and second exhaust pipes are arranged at positions rotationally symmetric to each other by 180° with respect to a vertical axis passing through the center of the cabinet. Since panels constituting right and left walls of the cabinet are fabricated by one process thus to be commonly applied to the right and left sides of the cabinet, the number of fabrication processes is reduced thus to enhance a productivity.

7 Claims, 6 Drawing Sheets

CLOTHES DRYER

BACKGROUND OF THE INVENTION

1. Field of the Invention

The present invention relates to a clothes dryer, and more particularly, to a clothes dryer capable of reducing a fabrication cost and enhancing operation efficiency.

2. Description of the Conventional Art

Generally, a clothes dryer is separately installed from a washing machine thereby to automatically dry wet clothes that has completed a washing operation. According to a drying method, the clothes dryer can be divided into a condensation type and an exhaust type.

The condensation type clothes dryer is provided with a heat exchanger for condensing moisture included in air that has passed through a drum therein. The condensation type clothes dryer circulates air therein thus to discharge condensed water outwardly, and heats dry air by a heater thus to supply into the drum, thereby drying clothes inside the drum.

The exhaust type clothes dryer sucks external air, heats the sucked air by a heater thus to introduce into a drum, and discharges air that has passed through the drum outwardly, thereby drying clothes inside the drum.

As shown in FIG. 1, the conventional exhaust type clothes dryer comprises: a cabinet 100 having an inlet 101 for introducing clothes and a door 11 for opening and closing the inlet 101 at a front side thereof; a drum 12 rotatably installed in the cabinet 100 and for accommodating clothes; a drum rotation device 14 for rotating the drum 12; an air circulation device 15 for sucking external air into the cabinet 100 and thereby introducing into the drum 12, and discharging air that has passed through the drum 12 outwardly; and a heater 16 for heating air introduced into the drum 12.

The drum rotation device 14 includes: a driving motor 13 arranged at one side of the drum 12 and generating a rotational force; a pulley 14*a* installed at a rotational shaft of the driving motor 13; and a belt 14*b* installed to cover outer circumferences of the drum 12 and the pulley 14*a*, for transmitting a rotational force of the driving motor 13 to the drum 12.

The air circulation device 15 includes: a suction port 15*a* formed at a rear panel of the cabinet 100, for sucking external air into the cabinet 100; a suction duct 15*b* respectively connected to inside of the cabinet 100 and an opening portion 12*b* formed at a rear side of the drum 12, for introducing air that has been sucked into the cabinet 100 into the drum 12; a fan 15*c* installed in the suction duct 15*b* and connected to the driving motor 13 thus to be rotated, for sucking external air and thereby introducing into the drum 12; an exhaust duct 15*d* connected to an opening portion 12*a* formed at a front side of the drum 12, for discharging air that has passed through the drum 12; and an exhaust port 150 connected to the exhaust duct 15*d*, for discharging air that has passed through the exhaust duct 15*d* to outside of the dryer.

As shown in FIG. 2, the exhaust port 150 is composed of: an exhaust chamber 152 connected to the exhaust duct 15*d*; first and second exhaust pipes 154 and 156 respectively diverged to the left side and the right side of the cabinet 100 from the exhaust chamber 152; and a third exhaust pipe 158 diverged to the rear side of the cabinet 100.

Exits 154*a* and 156*a* of the first and second exhaust pipes 154 and 156 are arranged at positions linearly symmetric to each other with respect to a horizontal center axis H of the cabinet 100. The exits 154*a* and 156*a* are connected to exhaust holes 102*a* and 104*a* formed at a left panel 102 and a right panel 104 constituting the left wall and the right wall of the cabinet 100.

The first and second exhaust pipes 154 and 156 guide air that has passed through the exhaust duct 15*d* and the exhaust chamber 152 to the left side or the right side of the cabinet 100.

The first, second, and third exhaust pipes 154, 156, and 158 are respectively opened or closed according to an installation position of the clothes dryer, and thereby a direction of air discharged to outside of the dryer is set.

However, in the conventional clothes dryer, since the exits 154*a* and 156*a* of the first and second exhaust pipes 154 and 156 are linearly symmetric to each other on the basis of the horizontal center axis H of the cabinet 100, positions of the exhaust holes 102*a* and 104*a* formed at the left panel 102 and the right panel 104 of the cabinet 100 are different.

According to this, the left panel 102 where the exhaust hole 102*a* is formed can not be assembled to the right side of the cabinet 100, and the right panel 104 where the exhaust hole 104*a* is formed can not be assembled to the left side of the cabinet 100. Therefore, even if the left panel 102 and the right panel 104 are formed as similar shapes to each other, a process for forming the exhaust hole 102*a* at the left panel 102 and a process for forming the exhaust hole 104*a* at the right panel 104 have to be individually performed. According to this, the number of fabrication processes is increased thus to lower an operation efficiency and to increase a fabrication cost.

SUMMARY OF THE INVENTION

Therefore, an object of the present invention is to provide a clothes dryer capable of reducing the number of fabrication processes and a fabrication cost by installing exhaust holes at the same position of lateral panels of a cabinet that forms an appearance.

To achieve these and other advantages and in accordance with the purpose of the present invention, as embodied and broadly described herein, there is provided a clothes dryer comprising: a cabinet; a drum rotatably installed within the cabinet; and an exhaust port for discharging air having passed through the drum, wherein the exhaust port includes first and second exhaust pipes respectively diverged to both sides of the cabinet, and exits of the first and second exhaust pipes are arranged at positions rotationally symmetric to each other by 180° with respect to a vertical axis passing through the center of the cabinet.

To achieve these and other advantages and in accordance with the purpose of the present invention, as embodied and broadly described herein, there is provided a clothes dryer comprising: a cabinet having a space therein as at least two panels are coupled to a periphery thereof; a drum rotatably installed within the cabinet; and at least two exhaust pipes connected to the drum, for discharging air having passed through the drum, wherein each panel is provided with an exhaust hole connected to the exhaust pipe, and the exhaust hole is arranged at the same position of each panel.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a preferred embodiment of the present invention will be explained with reference to the attached drawings.

Figure 1:
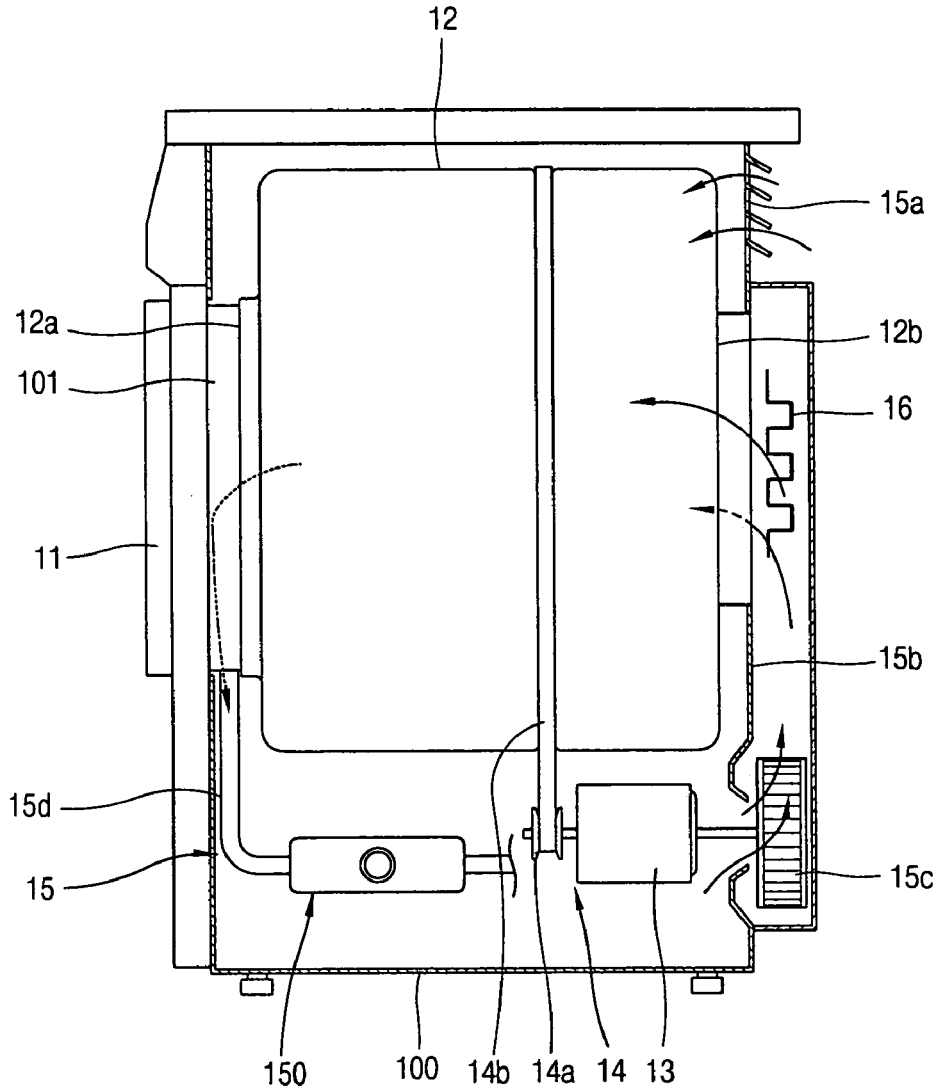
FIG. 1 CONVENTIONAL ART
FIG. 1 is a sectional view showing a clothes dryer in accordance with the conventional art.
Figure 2:
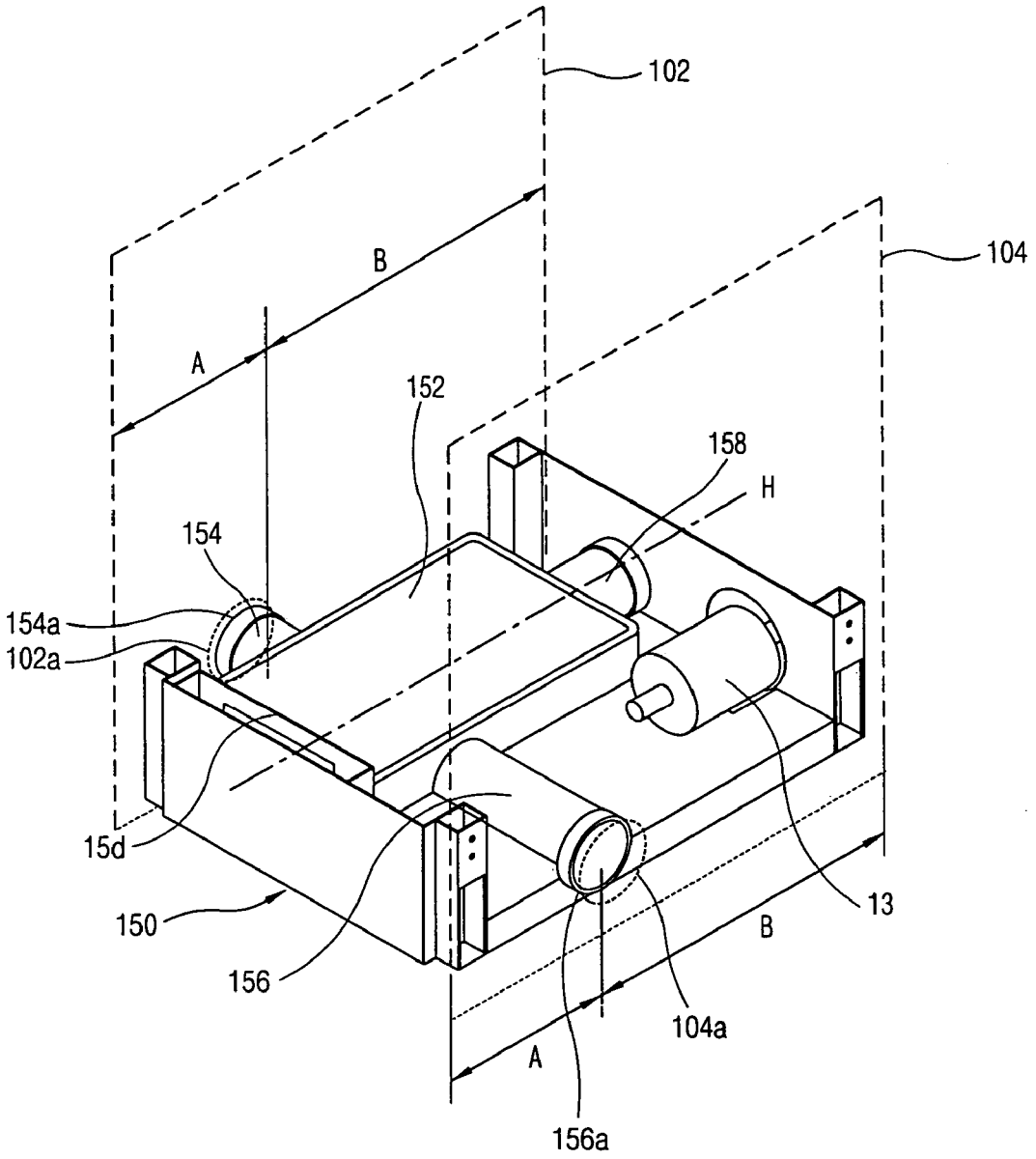
FIG. 2 CONVENTIONAL ART
FIG. 2 is a perspective view showing an exhaust port provided at the clothes dryer in accordance with the conventional art.
Figure 3:
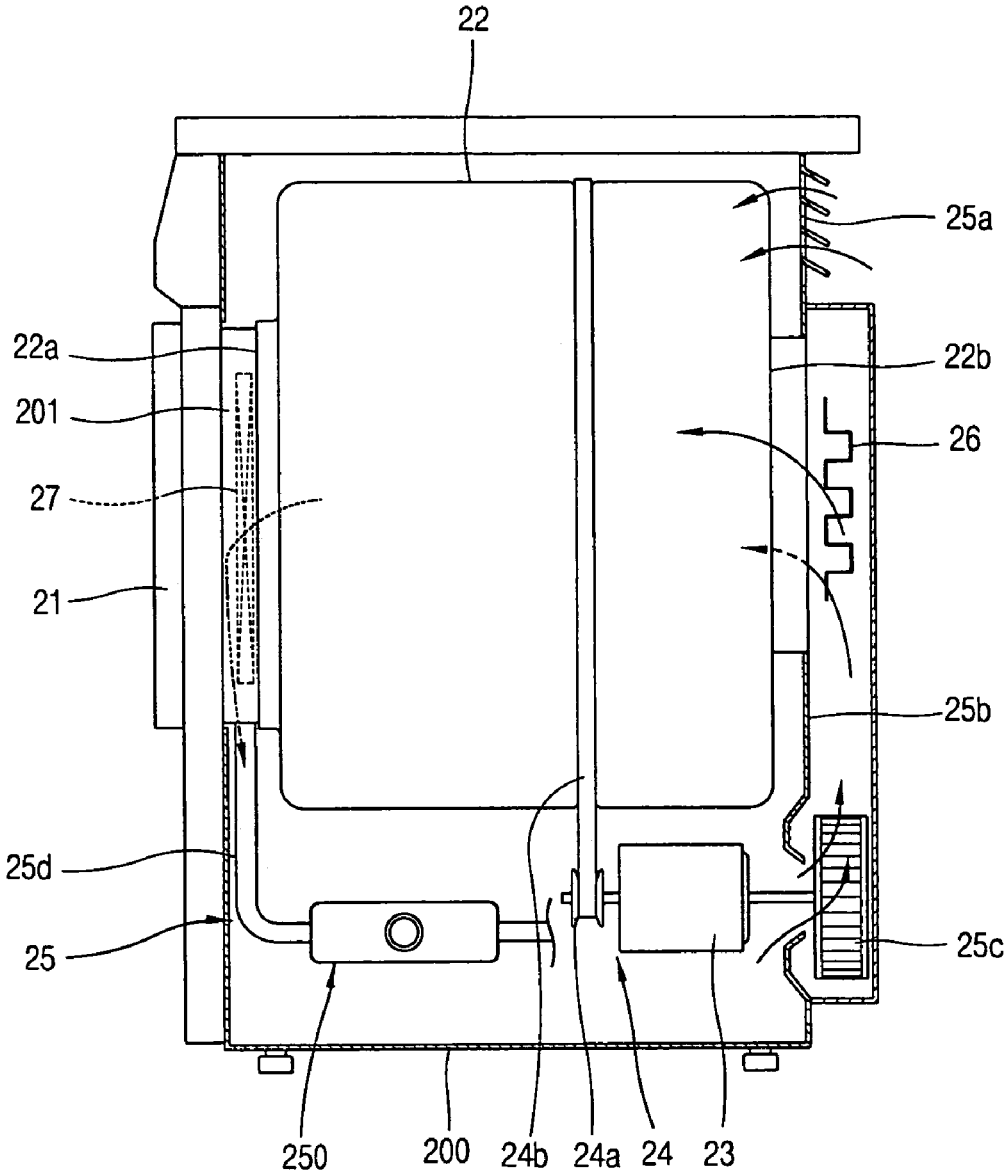
FIG. 3 is a sectional view showing a clothes dryer according to the present invention.

As shown in FIG. 3, the clothes dryer according to the present invention comprises: a cabinet 200 having an inlet 201 for introducing clothes and a door 21 for opening and closing the inlet 201 at a front side thereof; a drum 22 rotatably installed in the cabinet 200 and for accommodating clothes; a drum rotation device 24 for rotating the drum 22; an air circulation device 25 for sucking external air into the cabinet 200 and thereby introducing into the drum 22, and discharging air that has passed through the drum 22 outwardly; and a heater 26 for heating air introduced into the drum 22.

Figure 4:
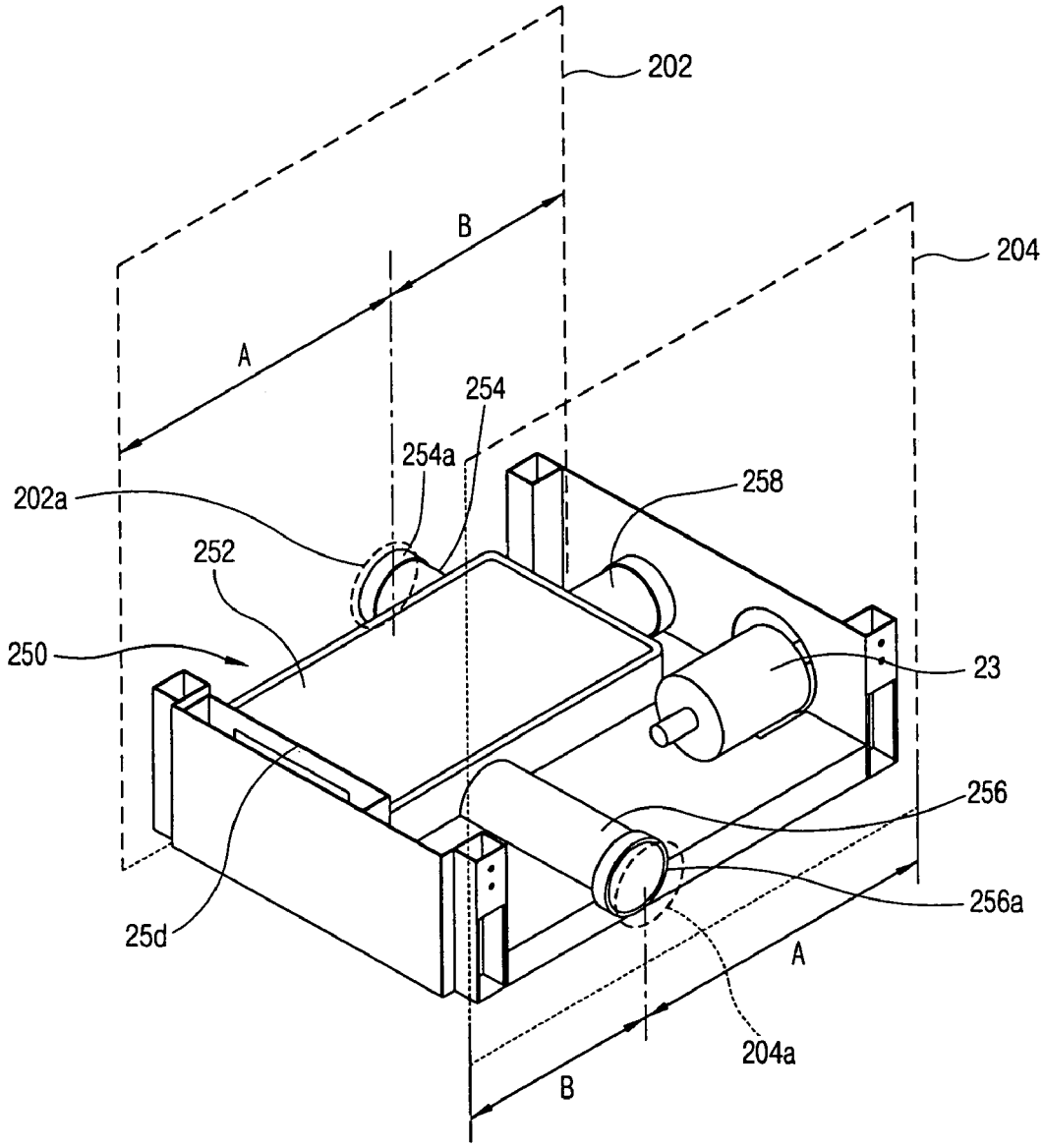
FIG. 4 is a perspective view showing an exhaust port provided at the clothes dryer according to the present invention.

The cabinet 200 has a structure that a left panel 202 and a right panel 204 that have the same width and height each other are coupled to the left side and the right side thereof (Refer to FIG. 4).

The drum rotation device 24 includes: a driving motor 23 arranged at one side of the drum 22 and generating a rotational force; a pulley 24*a* installed at a rotational shaft of the driving motor 23; and a belt 24*b* installed to cover outer circumferences of the drum 22 and the pulley 24*a*, for transmitting a rotational force of the driving motor 23 to the drum 22.

The air circulation device 25 includes: a suction port 25*a* formed at a rear panel of the cabinet 200, for sucking external air into the cabinet 200; a suction duct 25*b* respectively connected to inside of the cabinet 200 and an opening portion 22*b* formed at a rear side of the drum 22, for introducing air that has been sucked into the cabinet 200 into the drum 22; a fan 25*c* installed at the suction duct 25*b* and connected to the driving motor 23 thus to be rotated, for providing a suction force for sucking external air; an exhaust duct 25*d* connected to an opening portion 22*a* formed at a front side of the drum 22, for discharging air that has passed through the drum 22; a filter 27 installed at the opening portion 22*a* of the drum 22, for filtering foreign materials included in the air discharged from the drum 22 such as thread, etc.; and an exhaust port 250 connected to the exhaust duct 25*d*, for discharging air that has passed through the exhaust duct 25*d* to outside of the dryer.

Figure 5:
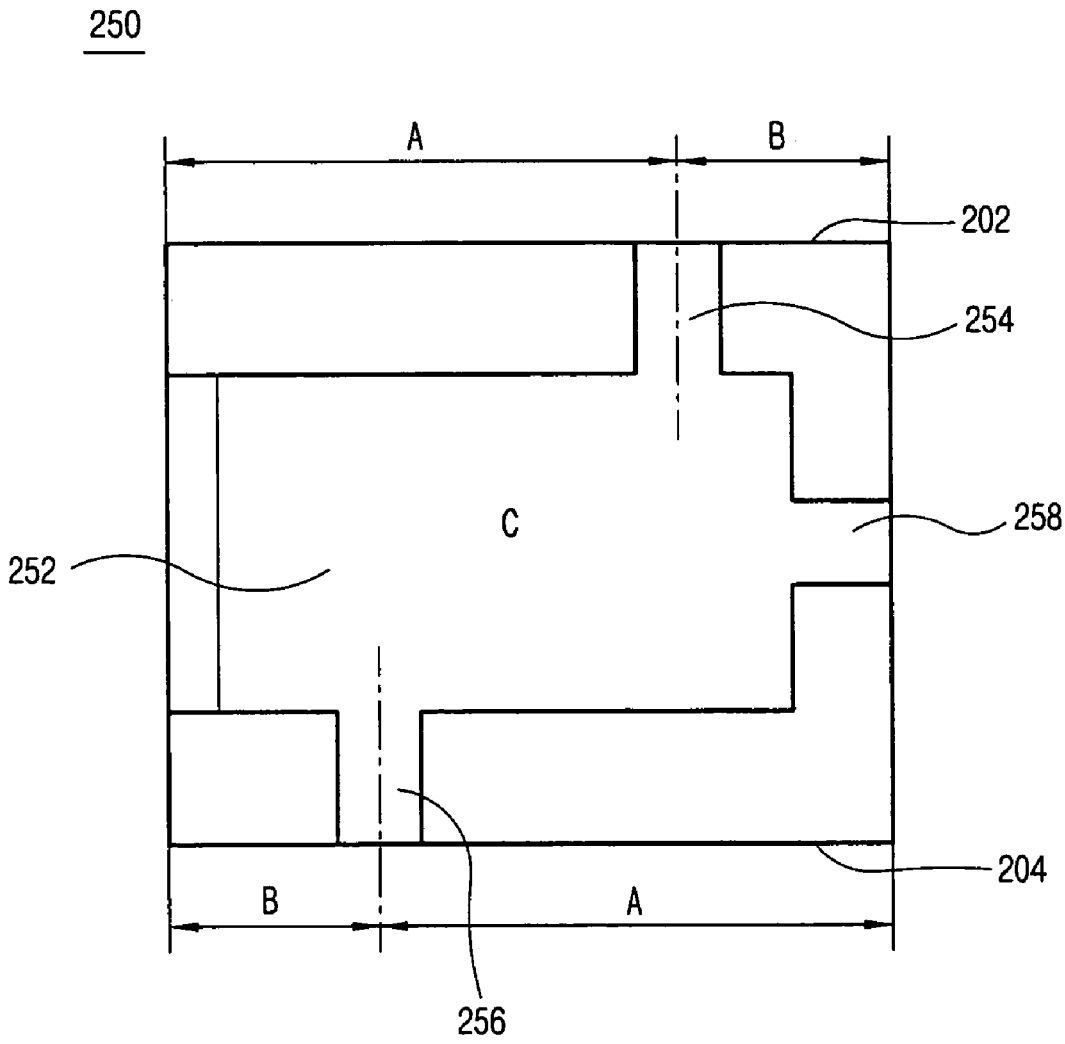
FIG. 5 is a schematic view showing the exhaust port provided at the clothes dryer according to the present invention.

As shown in FIGS. 4 and 5, the exhaust port 250 includes: an exhaust chamber 252 connected to the exhaust duct 25*d* and having an expanded space therein; first and second exhaust pipes 254 and 256 respectively extended to the left side and the right side of the cabinet 200 from the exhaust chamber 252; and a third exhaust pipe 258 extended to a perpendicular direction to the extension direction of the first and second exhaust pipes 254 and 256, that is, extended to a rear side of the cabinet 200.

The first and second exhaust pipes 254 and 256 guide air that has passed through the exhaust duct 25*d* and the exhaust chamber 252 to the right side or the left side of the cabinet 200. Also, the third exhaust pipe 258 guides air that has passed through the exhaust chamber 252 to the rear side of the cabinet 200. The first, second, and third exhaust pipes 254, 256, and 258 are opened or closed according to an installation position of the clothes dryer. According to the open or close state of the first, second, and third exhaust pipes 254, 256, and 258, a discharge direction of air to outside of the dryer is set. The first, second, and third exhaust pipes 254, 256, and 258 are respectively connected to an additional connection duct (not shown). Through the connection duct, air introduced into the first, second, and third exhaust pipes 254, 256, and 258 is discharged to outside of the cabinet 200.

Exits 254*a* and 256*a* of the first and second exhaust pipes 254 and 256 are connected to exhaust holes 202*a* and 204*a* respectively formed at the left panel 202 and the right panel 204 forming the left wall and the right wall of the cabinet 200.

The exits 254*a* and 256*a* of the first and second exhaust pipes 254 and 256 are arranged at positions rotationally symmetric to each other by 180° on the basis of a vertical axis passing through the center C of the cabinet 200. Also, the exhaust holes 202*a* and 204*a* respectively connected to the exits 254*a* and 256*a* of the first and second exhaust pipes 254 and 256 are arranged at positions rotationally symmetric to each other by 180° on the basis of the vertical axis passing through the center C of the cabinet 200.

Therefore, the exhaust holes 202*a* and 204*a* are formed at the same position of the left panel 202 and the right panel 204. According to this, the left panel 202 and the right panel 204 can be commonly used as the left wall or the right wall of the cabinet 200. Since the left panel 202 and the right panel 204 can be simultaneously fabricated through a single process, productivity and efficiency can be increased and a fabrication cost can be reduced.

The exits 254*a* and 256*a* of the first and second exhaust pipes 254 and 256 are respectively formed at positions eccentric to the center ((A+B)/2) in a width direction of the cabinet 200. The exhaust holes 202*a* and 204*a* are also respectively formed at positions eccentric to the center ((A+B)/2) in the width direction of the left panel 202 and the right panel 204.

Figure 6:
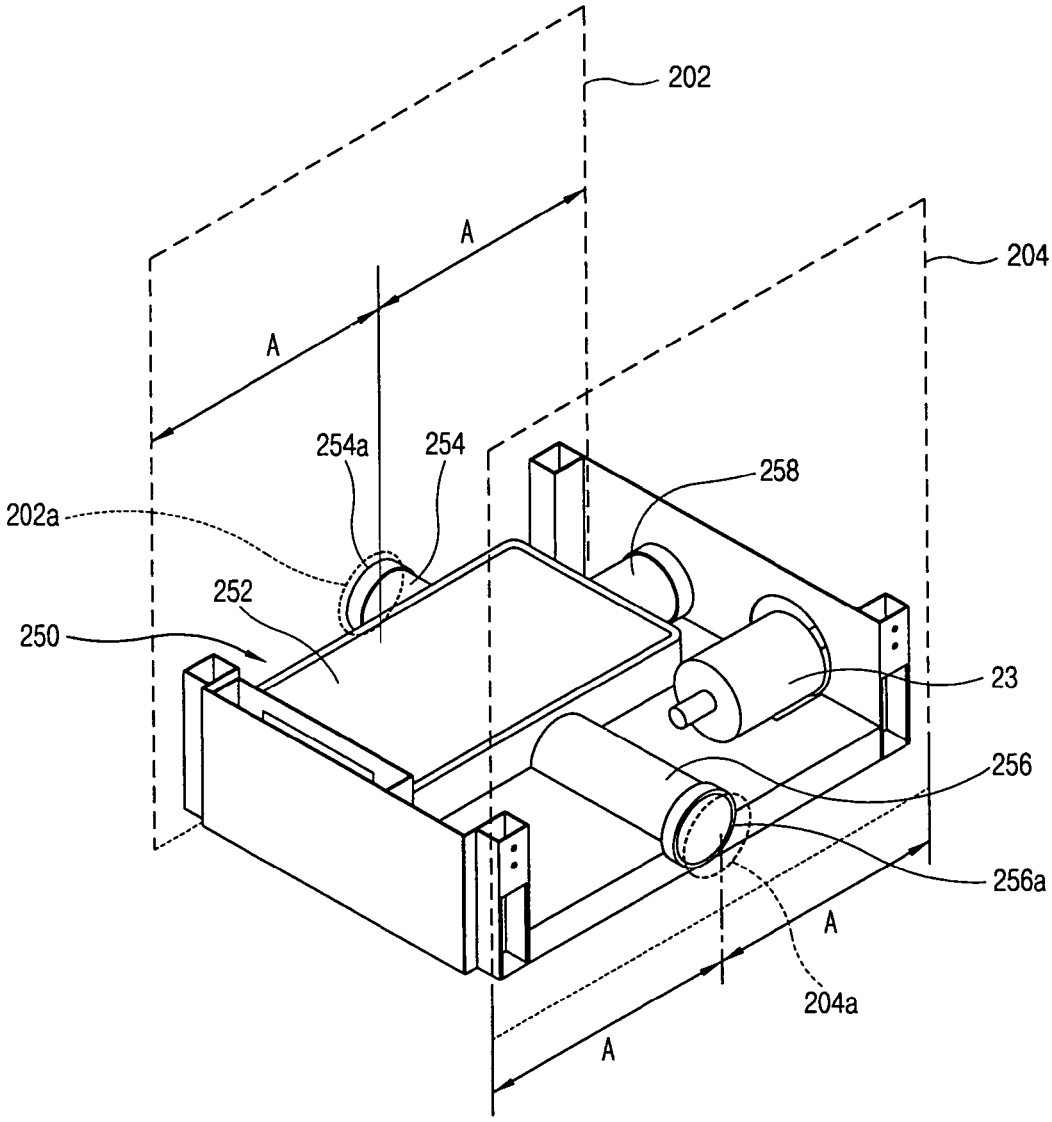
FIG. 6 is a perspective view showing another embodiment of the exhaust port provided at the clothes dryer according to the present invention.

However, as shown in FIG. 6, it is possible to position the exits 254*a* and 256*a* of the first and second exhaust pipes 254 and 256 at the center ((A+B)/2) in the width direction of the cabinet 200. In this case, the exhaust holes 202*a* and 204*a* are also positioned at the center in the width direction of the left panel 202 and the right panel 204.

In the clothes dryer of the present invention, when the driving motor 23 and the heater 26 are operated, the drum 22 connected to the driving motor 23, the pulley 24*a*, and the belt 24*b* is rotated thus to stir clothes accommodated in the drum 22. As the driving motor 23 is operated, the fan 25*c* is operated and thereby external air is sucked into the cabinet 200 through the suction port 25*a*. The sucked air is introduced into the drum 22 through the suction duct 25*b*. Herein, the air introduced into the drum 22 is heated by the heater 26 installed in the suction duct 25*b*.

The air of high temperature that has been introduced into the drum 22 deprives moisture of the clothes inside the drum 22, and the air including the moisture flows to the exhaust chamber 252 of the exhaust port 250 through the exhaust duct 25*d*. The air that has flown to the exhaust chamber 252 is discharged to outside of the dryer through the first, second, or the third exhaust pipes 254, 256, and 258 selectively opened and closed. By said process, the wet clothes inside the drum 22 are dried.

In the clothes dryer according to the present invention, a plurality of exhaust holes connected to a plurality of exhaust pipes for selectively discharging air that has passed through the drum are formed at a plurality of panels constituting the outer wall of the cabinet, and the exhaust holes are formed at the same position.

According to this, the plurality of panels are fabricated as the same shape thus to be used to constitute the outer wall of the cabinet, thereby decreasing the number of fabrication processes, decreasing a fabrication cost, and increasing a productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A clothes dryer, comprising:

a cabinet;

a drum rotatably installed within the cabinet; and an exhaust port that guides air that passes through the drum to an exterior of the cabinet, in a direction of at least one of a right side of the cabinet, a left side of the cabinet, and a rear side of the cabinet;

an exhaust chamber that includes an inner space connected to an outlet of the drum;

a first exhaust pipe that connects to the exhaust chamber and a first exhaust hole formed in a first panel of the cabinet; and a second exhaust pipe that connects to the exhaust chamber and a second exhaust hole formed in a second panel of the cabinet opposite the first panel, wherein the first exhaust hole is located in a position that is rotationally symmetrical to the position of the second exhaust hole with respect to a vertical axis passing through the center of the cabinet.

2. The clothes dryer of claim 1, wherein the first exhaust hole is located at a position other than a horizontal center of the first panel, and the second exhaust hole is located at a position other than a horizontal center of the second panel.

3. The clothes dryer of claim 1, wherein the first exhaust hole is located at a horizontal center of the first panel, and the second exhaust hole is located at a horizontal center of the second panel.

4. The clothes dryer of claim 1, further comprising a third exhaust pipe that connects to the exhaust chamber, and a third exhaust hole formed in a rear panel of the cabinet that is located between the first and second panels of the cabinet.

5. The clothes dryer of claim 1, wherein the first and second panels of the cabinet have a same height and width.

6. The clothes dryer of claim 1, wherein a distance between the first exhaust hole and a part of the exhaust chamber that connects to the outlet of the drum, is greater than a distance between the second exhaust hole and a part of the exhaust chamber that connects to the outlet of the drum.

7. The clothes dryer of claim 6, wherein the distance between the first exhaust hole and a horizontal center of the first panel corresponds to a distance between the second exhaust hole and a horizontal center of the second panel.

* * * * *